US006499178B1

(12) United States Patent
Huang

(10) Patent No.: US 6,499,178 B1
(45) Date of Patent: Dec. 31, 2002

(54) ASSEMBLY STRUCTURE FOR HAND TROWEL

(76) Inventor: Chin-Chen Huang, No.12, 41st Road, Industrial Zone, Shitun District, Taichung (TW)

( * ) Notice: Subject to any disclaimer, the term of this patent is extended or adjusted under 35 U.S.C. 154(b) by 0 days.

(21) Appl. No.: 09/986,699

(22) Filed: Nov. 9, 2001

(51) Int. Cl.[7] ..... B05C 17/10
(52) U.S. Cl. ..... 15/235.4; 425/458
(58) Field of Search ..... 15/235.4; 425/458

(56) References Cited

U.S. PATENT DOCUMENTS 5,479,675 1/1996 Pytlewski

FOREIGN PATENT DOCUMENTS

GB 2 236 502 * 4/1991

* cited by examiner

*Primary Examiner*—Randall E. Chin
(74) *Attorney, Agent, or Firm*—Rabin & Berdo, P.C.

(57) ABSTRACT

An assembly structure, consisting of a handle and a blade, having mainly a locking structure directly formed at the front of a tongue firmly integrated on the blade to provide relative insertion and movement between the said handle and the said blade with instantly precise, simple and convenient positioning as a groove inside the handle base and the tongue are in identical T-shape.

1 Claim, 3 Drawing Sheets

ASSEMBLY STRUCTURE FOR HAND TROWEL

FIELD OF THE INVENTION

The present invention relates to an assembly structure for a hand trowel. More specifically, it relates to a structure that provides precise and simple assembly and disassembly of a handle and a blade. The assembly structure further provides a firm and stable combination and positioning when corresponding parts are being moved against each other.

DESCRIPTION OF THE PRIOR ART

The early hand trowel adopted a configuration that allowed people to grasp a handle with their hands, with the handle being directly planted and fixed onto a blade. However, for applications in different places, shapes and areas of the blades may vary. In short, people should have a number of hand trowels with different shapes and areas. This not only increases costs, since each individual trowel must be purchased separately, but also causes inconvenience for storage and carriage. Please refer to U.S. Pat. No. 5,479,675, which discloses a hand trowel that can be assembled and is composed of a handle and a blade. The handle has a groove formed inside its base with flanges on both sides. The blade is integrated with a tongue having flanges on both sides. There is a keeper having an arm with bosses at the end. When the groove formed inside the handle base slides along the tongue on the blade and gets locked, the bosses at the end of the arm associated with the keeper installed at one side of the tongue lock into the openings on the handle base. Then the handle base and the tongue are combined to provide a positioning function. The disclosed assembly structure of U.S. Pat. No. 5,479,675 indeed achieves multiple objectives that include one single handle being combinable with many blades of different shapes and areas, reduced storage space when not in use and easy carrying.

In fact, further understanding of U.S. Pat. No. 5,479,675 reveals that the relative movement between the handle base and the blade tongue can not provide adjustable positioning upon combination without a keeper to help fixation. But when the handle and the blade are taken apart, disadvantages are presented with the inconvenience for assembly caused by the loss of the keeper, an individual part.

In view of the need of a structure that can provide precise and simple assembly and disassembly of the handle and the blade in a hand trowel and a firm and stable combination and positioning when corresponding parts are being moved against each other, the inventor creates the present invention.

SUMMARY OF THE INVENTION

The objective of the present invention is to provide an assembly structure for a hand trowel. The tongue installed on the blade has a T-shape and forms a direct locking structure at its front end. The handle has a T-shaped groove inside its base to match the T-shape tongue and corresponding openings on the wall of both sides at the open end. Through such a structure, when the T-shaped groove inside the handle base slides along the T-shape tongue associated with the blade and gets locked, a firm and stable combination and positioning can be provided.

DETAILED DESCRIPTION OF THE PREFERRED EMBODIMENT

Figure 1:
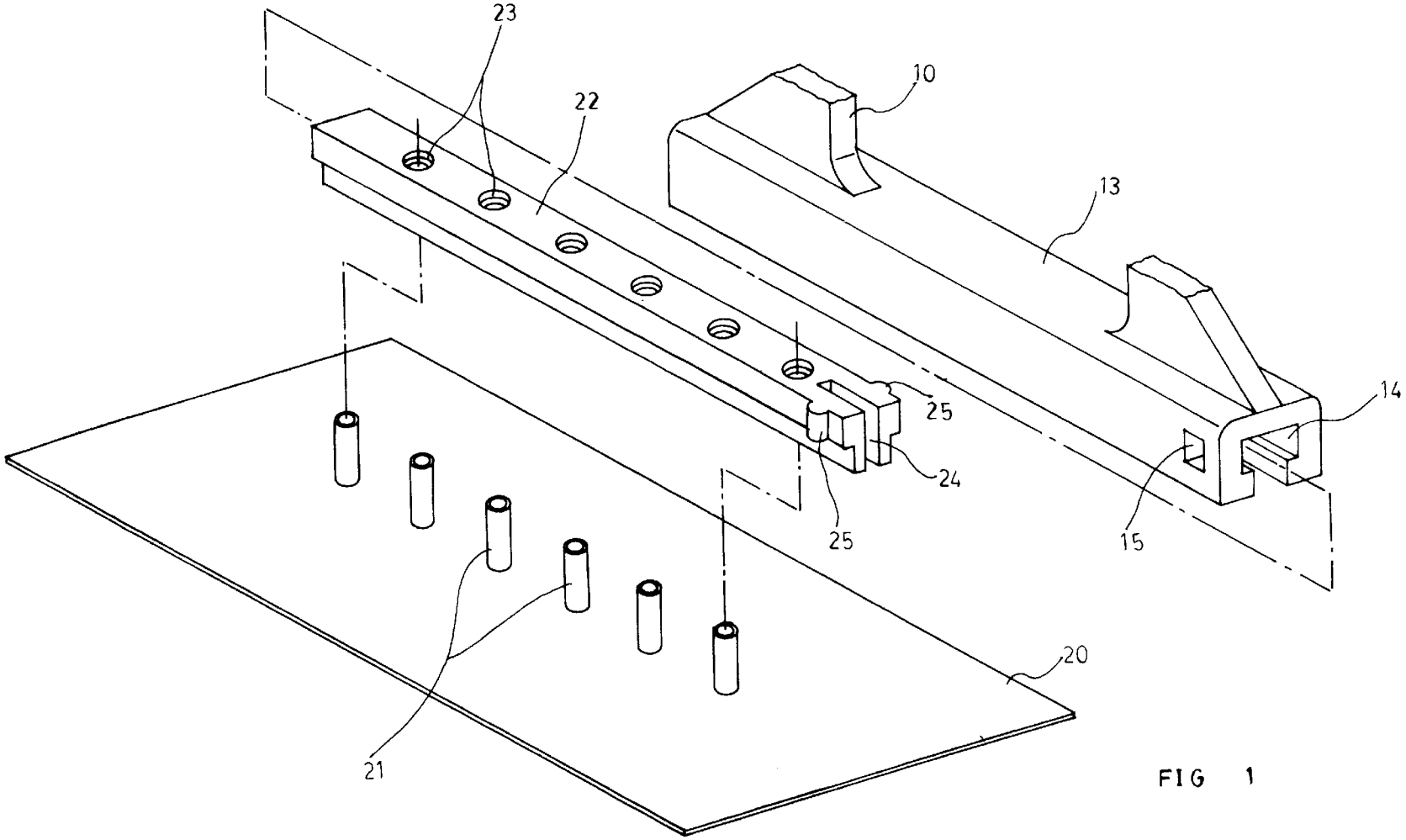
FIG. 1 is an exploded view of the present invention.
Figure 5:
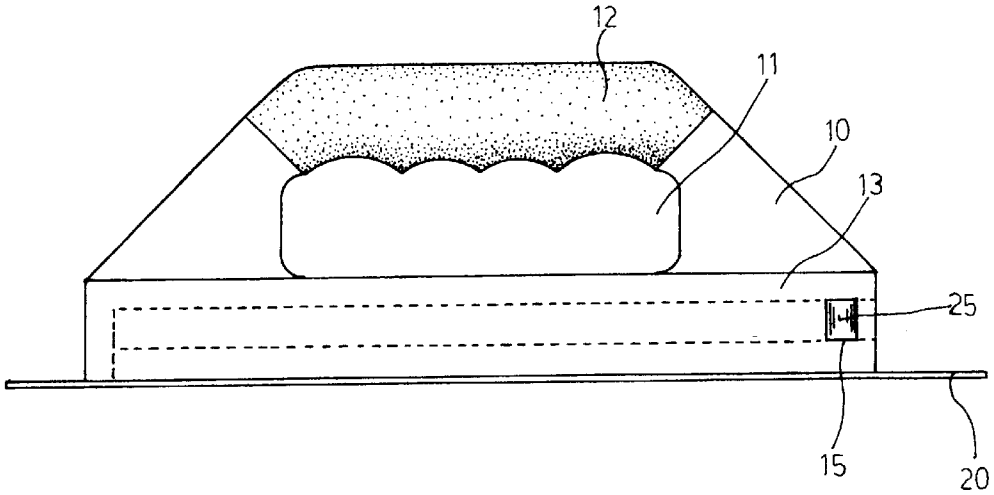
FIG. 5 is the side view of FIG. 4.
Figure 4:
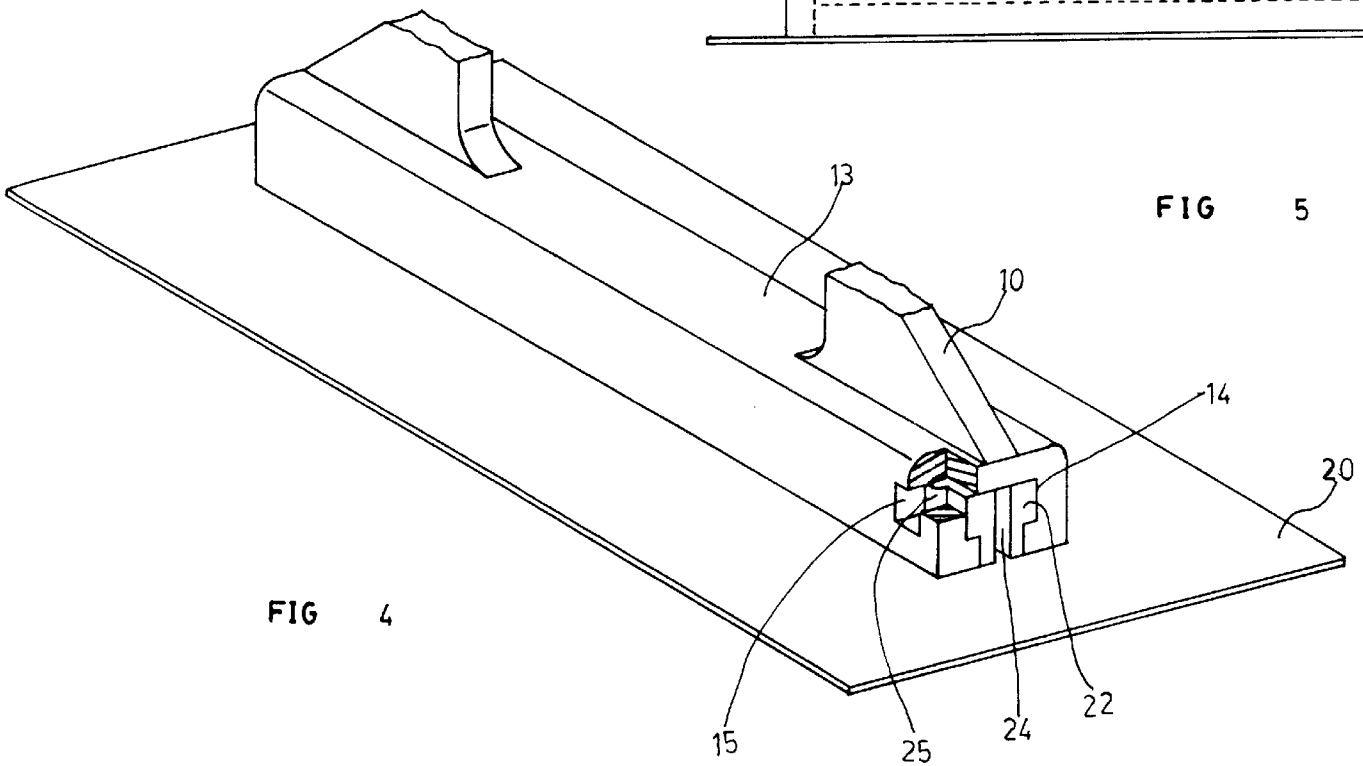
FIG. 4 is the illustrative example of the assembly of the handle and the blade in the present invention.

As shown in FIGS. 1, 4 and 5, the present invention is composed of a handle 10 and a blade 20. The handle 10 has a hollow space 11 for easy grasp by hands, and soft-resin made grasping section 12 on top for comfortable grasp and configured to be anti-slip. The handle also has an equivalently long or slightly longer strip base 13 integrated at its bottom, inside of which a T-shaped groove 14 exists. The groove 14 has a closed end at the back and is open at the front. On the walls of both sides of the groove 14 are corresponding openings 15.

The blade 20 can adopt different shapes and areas and is provided with several pillars 21. A tongue 22 having the identical shape as the T-shaped groove 14 is installed on the blade 20, and has several holes 23, a cleft 24, and a boss 25 on the wall of each side.

Figure 3:
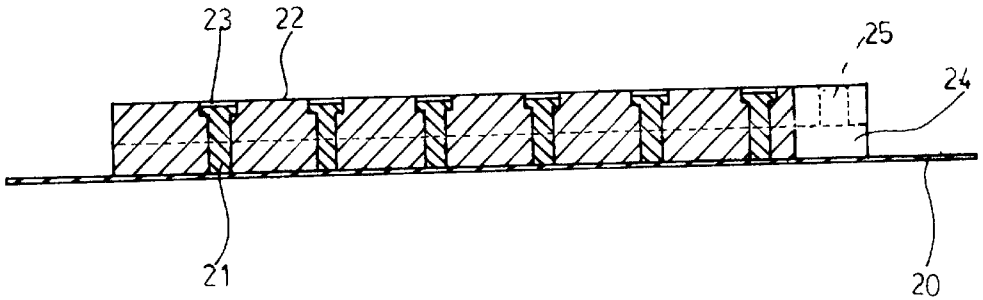
FIG. 3 is the cross-sectional view of FIG. 2.
Figure 2:
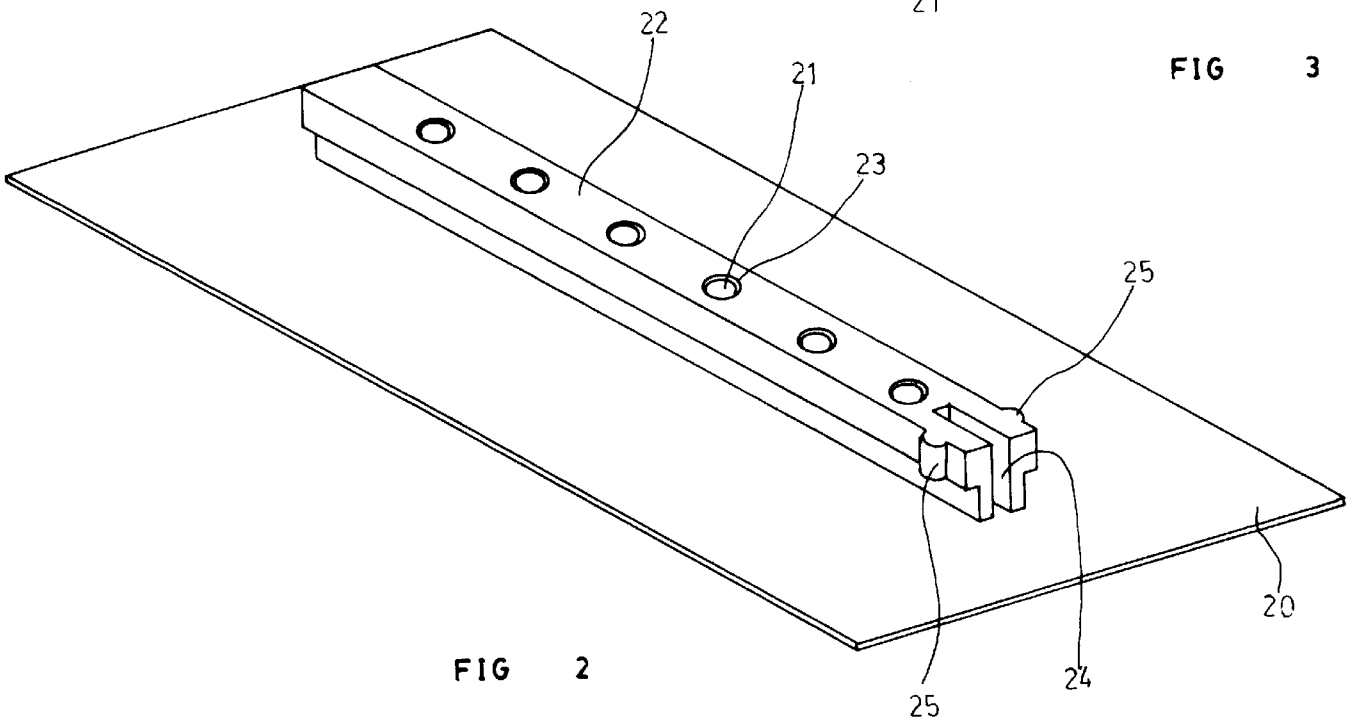
FIG. 2 shows the T-shaped tongue associated with the blade in the present invention.

As shown in FIG. 2 and FIG. 3, the tongue 22 is placed onto the pillars 21 of the blade 20 through the holes 23 and fixed by additional pressing nails.

As shown in FIG. 4 and FIG. 5, the handle 10 is combined with the blade 20 by inserting the tongue 22 within the groove 14, and moving the groove 14 inside the base 13 along the tongue 22. The T-shapes provide a firm and stable contacting effect. Until the inner wall of the groove 14 touches the bosses 25 on both walls at the front of the tongue 22, tension is generated by the cleft 24 pushing towards a center, and the bosses 25 immediately lock into the openings 15 on the base 13. Such insertion and movement through the locking structure provide a precise, simple and convenient method for assembly and positioning. On the other hand, the disassembly is as easy and fast as assembly is.

The above disclosure is one of the preferred embodiments. Those partially changed or modified and initiated from the idea of the present invention and derived by people familiar with the said techniques are still within the scope of the present invention.

What is claimed is:

1. An assembly structure for a hand trowel, comprising:

a handle adapted to be grasped by a hand, and having a strip base integrated at a bottom thereof, the strip base having a T-shaped groove formed therein which is defined by opposing walls, and having corresponding openings formed in the walls at an open end of the groove;

a blade having a plurality of pillars; and a tongue fixed to the blade using the pillars, the tongue having a T-shape that is essentially identical in shape to the T-shaped groove, so as to be adapted to be slid and fit therein, the tongue having a cleft at a front thereof, and having a respective boss on opposing walls of the tongue in a region of the cleft, the bosses being receivable within the openings formed in the walls of the strip base to lock the blade to the handle in a set position, when the tongue is properly positioned within the groove.

* * * * *